US011939115B2

(12) United States Patent
Kreinbrink et al.

(10) Patent No.: US 11,939,115 B2
(45) Date of Patent: Mar. 26, 2024

(54) TAMPER EVIDENT CLOSURE

(71) Applicant: Berry Global, Inc., Evansville, IN (US)

(72) Inventors: Andrew Kreinbrink, Toledo, OH (US); Daniel A. Bloom, Bowling Green, OH (US); John A. Vassallo, Lititz, PA (US); Steven Daniel Gift, Lititz, PA (US); Darin Michael Pugne, Carnegie, PA (US)

(73) Assignee: Berry Global, Inc., Evansville, IN (US)

( * ) Notice: Subject to any disclaimer, the term of this patent is extended or adjusted under 35 U.S.C. 154(b) by 78 days.

(21) Appl. No.: 17/119,499

(22) Filed: Dec. 11, 2020

(65) Prior Publication Data

US 2021/0179323 A1 Jun. 17, 2021

Related U.S. Application Data

(60) Provisional application No. 62/946,651, filed on Dec. 11, 2019.

(51) Int. Cl.
*B65D 41/34* (2006.01)

(52) U.S. Cl.
CPC ..... *B65D 41/3409* (2013.01); *B65D 41/3428* (2013.01); *B65D 2401/30* (2020.05); *B65D 2401/35* (2020.05); *B65D 2401/40* (2020.05)

(58) Field of Classification Search
CPC ..... B65D 41/34; B65D 41/3409; B65D 41/3428; B65D 41/36; B65D 41/365; B65D 41/48; B65D 41/0421; B65D 2401/20; B65D 2401/30; B65D 2401/35; B65D 2401/40; B65D 2215/02; B65D 50/041; B65D 51/16; B65D 51/1633; B65D 51/1661
USPC ..... 215/250, 252–254, 256, 258, 341, 215/343–344, 329; 220/303–304, 293, 220/288, 265–266, 203.09, 203.01, 220/801–804, 806, 796; 222/541.6, 222/541.1, 563
See application file for complete search history.

(56) References Cited

U.S. PATENT DOCUMENTS 3,055,524 A * 9/1962 Glasbrenner ..... B65D 50/041 215/220
3,472,411 A * 10/1969 Turner ..... B65D 50/041 D9/434
3,638,819 A * 2/1972 Roy ..... B65D 50/041 215/220

(Continued)

FOREIGN PATENT DOCUMENTS

GB 1529999 † 10/1978

OTHER PUBLICATIONS

PCT International Search and Written Opinion in corresponding International Application No. PCT/US2020/064610 dated Apr. 6, 2021, all enclosed pages cited.

*Primary Examiner* — Chun Hoi Cheung
*Assistant Examiner* — Brijesh V. Patel

(57) ABSTRACT

A closure including an outer shell and an inner shell that cooperate to provide child-resistant opening features is provided. The inner shell includes at least one lug that cooperates with at least one lug of the outer shell to provide the child-resistant opening feature. The closure also includes a tamper evident band to provide an indicator of when the closure has been opened relative to an underlying container.

19 Claims, 7 Drawing Sheets

(56) References Cited

U.S. PATENT DOCUMENTS 3,650,426 A * 3/1972 Miller ..... B65D 50/041 215/220
3,722,727 A * 3/1973 Gach ..... B65D 50/041 215/220
3,776,407 A * 12/1973 Cistone ..... B65D 50/041 215/301
3,797,688 A * 3/1974 Porcelli ..... B65D 50/041 215/220
3,809,272 A * 5/1974 Maki ..... B65D 50/041 215/219
3,830,390 A * 8/1974 Gach ..... B65D 50/041 215/220
3,853,236 A * 12/1974 Ostrowsky ..... B65D 50/041 215/220
3,863,796 A * 2/1975 Roy ..... B65D 50/041 215/220
4,286,633 A * 9/1981 Herr ..... B01L 3/0282 422/934
4,378,894 A * 4/1983 Willis ..... B65D 55/066 215/250
4,474,301 A * 10/1984 Davis ..... B65D 41/3452 215/258
4,520,938 A * 6/1985 Finke ..... B65D 50/041 215/220
4,523,688 A * 6/1985 Puresevic ..... B65D 50/041 215/220
4,535,905 A * 8/1985 Sandhaus ..... B65D 50/046 215/218
4,555,036 A * 11/1985 Bekkers ..... B65D 55/024 215/220
4,598,833 A † 7/1986 Herr
4,609,114 A * 9/1986 Roy ..... B65D 50/041 215/220
4,632,264 A * 12/1986 Evans ..... B65D 50/041 215/220
4,669,620 A * 6/1987 Coifman ..... B65D 55/024 215/220
4,705,181 A * 11/1987 Burke ..... B65D 47/06 215/44
4,723,685 A * 2/1988 Fillmore ..... B65D 50/041 215/350
4,801,030 A * 1/1989 Barriac ..... B65D 41/3428 215/258
4,854,459 A * 8/1989 DeJonge ..... B65D 50/041 215/220
4,997,096 A † 3/1991 Kusz
5,007,545 A * 4/1991 Imbery, Jr. ..... B65D 41/3428 215/901
5,058,755 A * 10/1991 Hayes ..... B29C 57/00 215/252
5,090,788 A * 2/1992 Ingram ..... B29C 69/02 215/252
5,197,620 A * 3/1993 Gregory ..... B65D 41/3428 220/366.1
5,280,842 A * 1/1994 Koo ..... B65D 50/041 215/220
5,358,133 A * 10/1994 Gillispie ..... B65D 39/08 220/284
5,433,329 A * 7/1995 Weinstein ..... B65D 50/041 215/220
5,443,171 A 8/1995 Sprowl
5,540,349 A * 7/1996 Philips ..... B65D 43/0256 206/508
5,611,443 A * 3/1997 King ..... B65D 50/041 215/220
5,676,268 A * 10/1997 King ..... B65D 41/3447 215/217
5,695,083 A * 12/1997 Obadia ..... B65D 41/3428 215/320
5,743,419 A * 4/1998 King ..... B65D 51/242 215/217
5,901,870 A * 5/1999 Wagner ..... B65D 41/48 215/256
6,003,700 A * 12/1999 Julian ..... B65D 50/046 215/217
6,006,930 A † 12/1999 Dreyer
6,206,216 B1 † 3/2001 Stalions
6,477,823 B1 † 11/2002 Kitterman
6,779,672 B2 * 8/2004 Kano ..... B65D 41/0421 215/354
7,344,039 B2 * 3/2008 Bixler ..... B65D 41/3428 215/258
7,401,707 B2 * 7/2008 Brozell ..... B65D 50/041 215/230
7,513,377 B1 * 4/2009 Culley ..... B65D 41/3428 215/901
7,850,028 B2 12/2010 Morini
7,866,496 B2 † 1/2011 Kraft
8,231,018 B2 * 7/2012 Gassner ..... B65D 41/3447 215/256
8,302,794 B2 * 11/2012 Russell ..... B65D 41/3423 215/258
8,474,634 B1 * 7/2013 Branson ..... B65D 50/041 215/230
8,534,476 B2 9/2013 Brozell
8,763,830 B2 * 7/2014 Sadiq ..... B65D 51/1661 215/901
8,857,638 B2 * 10/2014 Brozell ..... B65D 50/041 220/255
D723,919 S * 3/2015 Taber ..... D9/453
9,586,738 B2 3/2017 Herrbach et al.
2004/0169000 A1 * 9/2004 Ramsey ..... B65D 50/046 215/219
2005/0072751 A1 * 4/2005 Price ..... B65D 41/3428 215/252
2005/0161425 A1 7/2005 Morini
2006/0021959 A1 * 2/2006 Falzoni ..... B65D 41/045 215/258
2006/0219651 A1 * 10/2006 Takahashi ..... B65D 50/041 215/220
2007/0199912 A1 * 8/2007 Libohova ..... B65D 50/041 215/220
2008/0087625 A1 * 4/2008 Kumata ..... B65D 41/0485 215/252
2008/0173611 A1 * 7/2008 Neputy ..... B65D 41/3423 215/256
2009/0032486 A1 * 2/2009 Brozell ..... B65D 50/041 215/220
2010/0032402 A1 * 2/2010 Widmer ..... B65D 41/3447 215/329
2011/0024423 A1 * 2/2011 Erspamer ..... B65D 41/3428 220/266
2012/0085725 A1 * 4/2012 Parekh ..... B65D 50/041 215/220
2014/0014611 A1 * 1/2014 Buehler ..... B65D 50/041 215/217
2015/0122767 A1 * 5/2015 Mettu ..... B65D 50/041 215/220
2017/0050773 A1 * 2/2017 Rognard ..... B65D 41/3428
2019/0039787 A1 * 2/2019 Benoit-Gonin ..... B65D 41/485
2019/0135507 A1 * 5/2019 Schlusemann ..... B65D 41/0421
2019/0263569 A1 * 8/2019 Smith ..... B65D 41/3433

* cited by examiner
† cited by third party

TAMPER EVIDENT CLOSURE

PRIORITY CLAIM

This application claims priority under 35 U.S.C. § 119(e) to U.S. Provisional Application Ser. No. 62/946,651, filed Dec. 11, 2019, which is expressly incorporated by reference herein.

TECHNICAL FIELD

The present disclosure relates generally to a closure, and more specifically to a tamper evident and child resistant closure for a container.

BACKGROUND

It is often desirable to store product or contents in a container or package. It is often desirable to close the container with a closure. A closure may be provided with tamper evident and child resistant features.

SUMMARY

Certain embodiments according to the present disclosure provide a closure with tamper evident and child resistant features and/or a package including such a closure and a container.

In one aspect, for instance, a closure for a bottle is provided, with the closure having an inner shell and an outer shell. The inner shell includes at least one inner lug. The outer shell includes at least one outer lug. The outer lug is movable relative to the inner lug between an engaged position and a disengaged position. In the disengaged position, the outer lug is able to rotate past the inner lug when rotated in an opening direction. In the engaged position the outer lug engages the inner lug when rotated in an opening direction to cause opening direction rotation of the inner shell. A tamper band is included, which extends downwardly from a skirt of the inner shell. The tamper band includes a portion that extends radially inwardly to engage a bead of the bottle.

In another aspect, for instance, a closure for a bottle is provided and the closure includes an inner shell and an outer shell. The inner shell includes at least one inner lug. The outer shell includes at least one outer lug. The outer lug is axially movable relative to the inner lug between an engaged position and a disengaged position. In the disengaged position the outer lug is axially displaced relative to the inner lug such that the outer lug is able to rotate past the inner lug when rotated in an opening direction. In the engaged position, the outer lug is at least partially circumferentially aligned with the inner lug such that the outer lug engages the inner lug when rotated in an opening direction to cause opening direction rotation of the inner shell. A tamper band is included that extends downwardly from a skirt of the inner shell. The tamper band includes a portion that extends radially inwardly to engage a bead of the bottle.

In yet another aspect, for instance, a package is provided that includes a container having a product storage region and a neck defining an opening, and a container having an inner shell and an outer shell. The inner shell includes at least one inner lug. The outer shell includes at least one outer lug. The outer lug is movable relative to the inner lug between an engaged position and a disengaged position. In the disengaged position the outer lug is able to rotate past the inner lug when rotated in an opening direction. In the engaged position the outer lug engages the inner lug when rotated in an opening direction to cause opening direction rotation of the inner shell. A tamper band is included that extends downwardly from a skirt of the inner shell. The tamper band includes a portion that extends radially inwardly to engage a bead of the container.

BRIEF DESCRIPTION OF THE DRAWINGS

Embodiments now will be described more fully hereinafter with reference to the accompanying drawings, in which some, but not all embodiments may be shown. Indeed, embodiments may be illustrated or described in many different forms and the present disclosure should not be construed as limited to the embodiments set forth herein. Like numbers refer to like elements throughout, and wherein.

DETAILED DESCRIPTION

Embodiments now will be described more fully hereinafter with reference to the accompanying drawings, in which some, but not all embodiments may be shown. Indeed, embodiments may take many different forms and the present disclosure should not be construed as limited to the embodiments set forth herein; rather. As used in the specification, and in the appended claims, the singular forms "a", "an", "the", include plural referents unless the context clearly dictates otherwise.

The terms "substantial" or "substantially" may encompass the whole as specified, according to certain embodiments, or largely but not the whole specified according to other embodiments.

Figure 1:
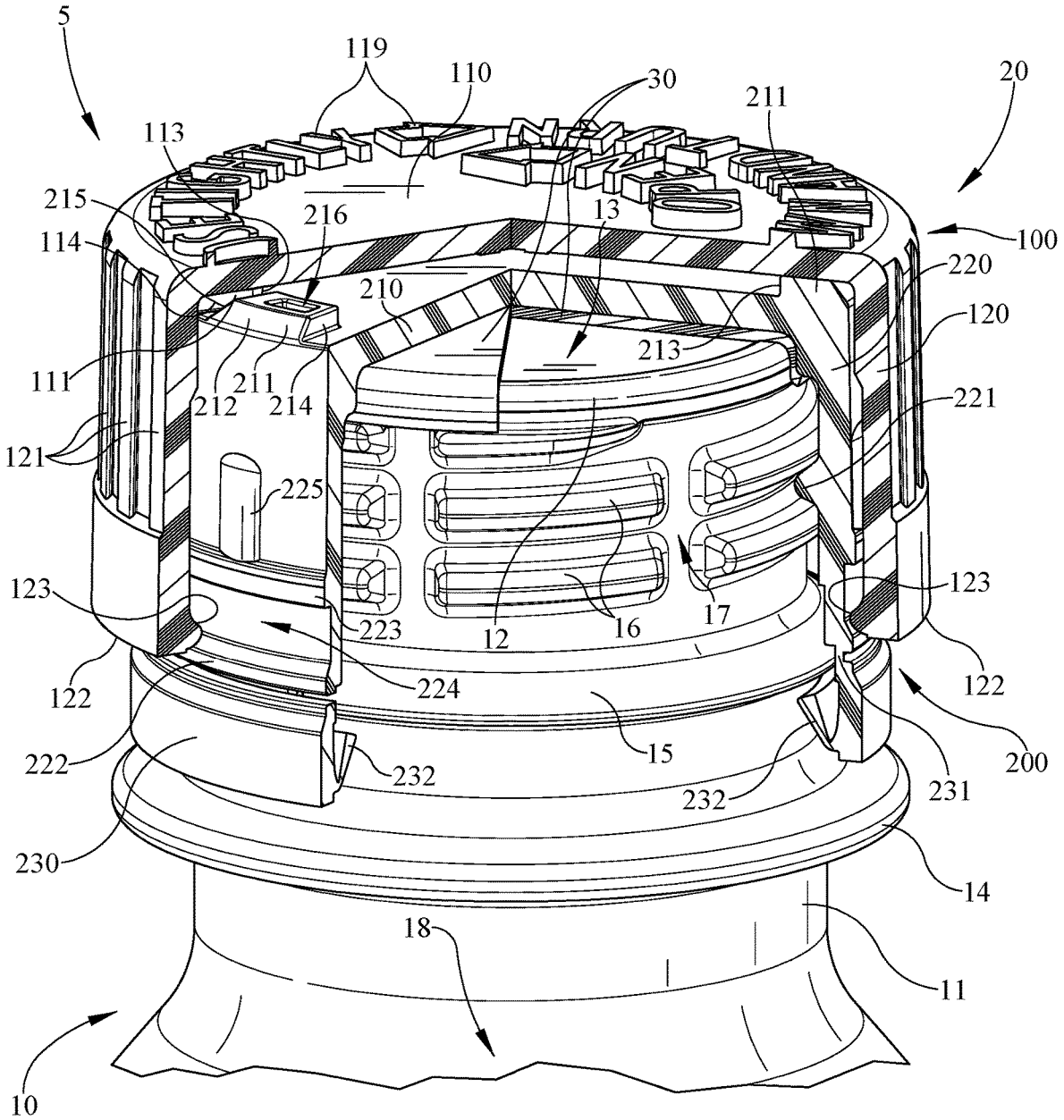
FIG. 1 illustrates a perspective view of an embodiment of a closure shown partially cut away to show internal features of the closure in more detail.

Some embodiments of a package 5 may include a closure 20 coupled to a bottle 10, such as is shown for example in FIG. 1. Closure 20 may include an inner shell 200 that is configured to couple to bottle 10, for example at or near neck 11, and an outer shell 100 that is configured to couple to inner shell 200. The coupled combination of outer shell 100 and inner shell 200 may substantially form closure 20. A liner 30 may be included, for example, to provide additional sealing between inner shell 200 and bottle 10 or for any other reason. Liner 30 may be a foil seal or plastic film, for example, which may be removably sealed to neck 11 to cover an opening 13 and/or a product storage region 18.

Closure 20 may include a tamper evident feature such as a tamper band 230, which may be located at or near a lower portion of inner shell 200, for example. Inner shell 200 may be rotatably coupled to bottle 10, for example, by the cooperation of one or more external threads 16 on bottle 10 and one or more internal threads 221 on inner shell 200. Inner shell 200 and/or closure 20 may be rotatably removed from and/or coupled to bottle 10 via threads 16, 221 and/or other mechanisms. Outer shell 100 may be configured to block access to a skirt 220 of inner shell 200 for any of a variety of reasons, including but not limited to preventing or inhibiting rotation of inner shell 200 relative to bottle 10 to inhibit removal of inner shell 200 and/or closure 20. Such prevention of rotation of inner shell 200 and/or removal of inner shell 200 and/or closure 20 from bottle 10 may provide an opening feature that is child-resistant.

In order to overcome the child-resistant opening mechanism, outer shell 100 may be configured to engage inner shell 200 when subject to a first user input, such as a force pushing or moving outer shell 100 downward and/or toward inner shell 200. For example, a user may push down on a lid 110 of outer shell 100 thereby biasing or moving outer shell 100 downward toward inner shell 200, which may allow or facilitate engagement of one or more outer shell lugs 111 with one or more inner shell lugs 211. Engagement and/or cooperation of outer lugs 111 with inner lugs 211 may allow rotation of outer shell 100 to cause rotation of inner shell 200 to allow or facilitate rotational removal of inner shell 200 and/or closure 20 from bottle 10 via the threaded engagement. For example, in the engaged position outer lugs 111 and inner lugs 211 may be circumferentially aligned and/or axially overlapping, at least partially, so that rotation of one about a central axis will cause contact with the other and in turn rotation of the other about the central axis. Alternatively or additionally, friction between outer lugs 111 and inner lugs 211 may cause engagement, cooperation, and/or motion of one relative to the other, for example, if a user is pushing down on outer shell 100 to cause friction of outer lugs 111 with inner lugs 211 and/or cam face 215. Outer lugs 111 and/or inner lugs 211 may be configured such that they do not engage or cooperate in the absence of the user input (e.g., downward force or motion). In the absence of the user input, outer shell 100 may substantially rotate freely on inner shell 200 without causing rotation and/or removal of inner shell 200 relative to bottle 10.

Bottle 10 may include product storage region 18, which may be configured to store any of a variety of products, including pressurized contents such as a carbonated beverage. Bottle 10 may include neck 11 and/or a top rim 12 surrounding and/or defining opening 13 into bottle 10 and/or product storage region 18. Bottle 10 may include a flange 14 for any of a variety of reasons, including locating closure 20 on bottle 10 and/or providing a structure that may be grabbed and/or lifted, for example, to move or hold bottle 10 during a filling process. One or more vent slots 17 may be included in bottle 10, for example, by providing breaks or gaps in external thread 16 of bottle 10, for any of a variety of reasons, including but not limited to providing a venting opening through which pressurized gas or fluid may pass to allow controlled equalization of pressure. Bottle 10 may include a bead 15, which may be included to provide a blocking or stopping surface or structure for a folding strip 232 of tamper band 230 to block or inhibit upward motion of tamper band 230 relative to bead 15, or for any other reason or combination of reasons.

Tamper band 230 may be frangible and/or relatively easily disconnected from an inner shell skirt 220, for example, by including one or more frangible tabs 231. Frangible tabs 231 may allow separation of tamper band 230 from inner skirt 200 while also retaining at least a portion of tamper band 230 below bead 15 during upward motion of inner skirt 220 relative to bottle neck 11 during removal of closure 20 from package 5 or opening of package 5 by rotating closure 20 and/or inner shell 200. Tamper band 230 and/or frangible tabs 231 may provide an indication of whether closure 20 has been removed from bottle 10 thereby rendering product storage region 18 potentially previously accessible by an unknown person, and/or otherwise provide evidence of tampering. Closure 20 may provide both resistance to opening of package 5 by a child and tamper evidence, for example, by including inner shell 200, outer shell 100, and tamper band 230.

Figure 2:
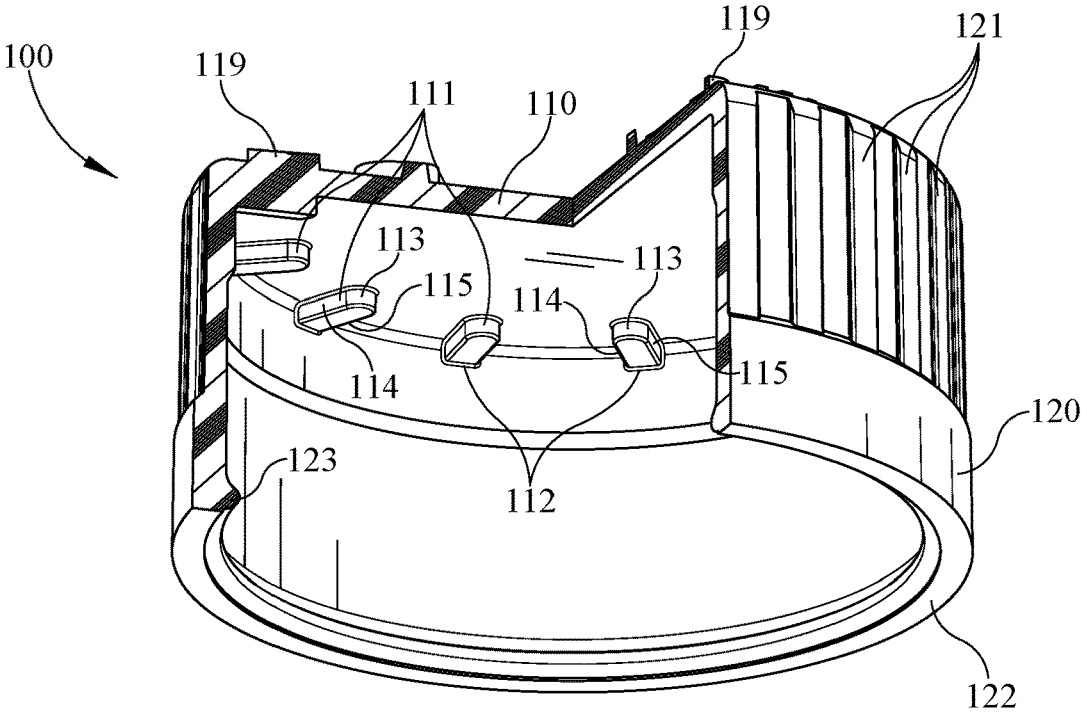
FIG. 2 illustrates a perspective view of an embodiment of an outer shell for use in the closure shown in FIG. 1, shown partially cut away to show the inside of the outer shell in more detail.
Figure 3:
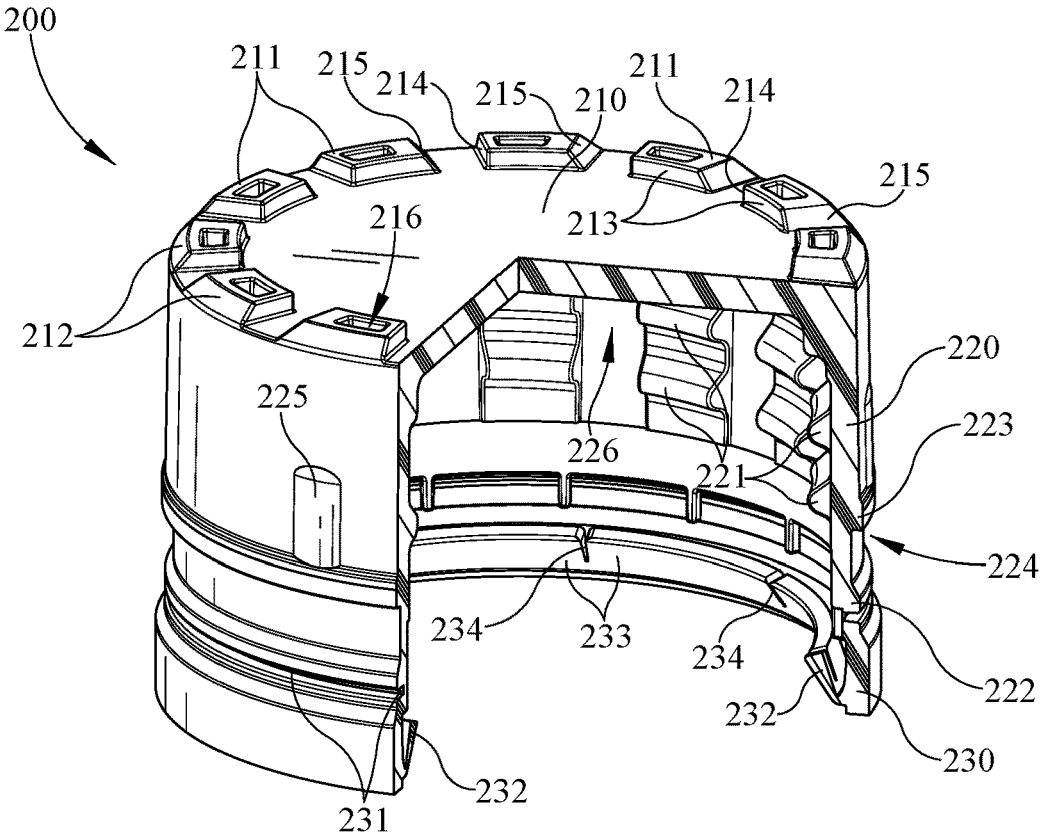
FIG. 3 illustrates a perspective view of an embodiment of an inner shell for use in the closure shown in FIG. 1, shown partially cut away to show the inside of the inner shell in more detail.
Figure 4:
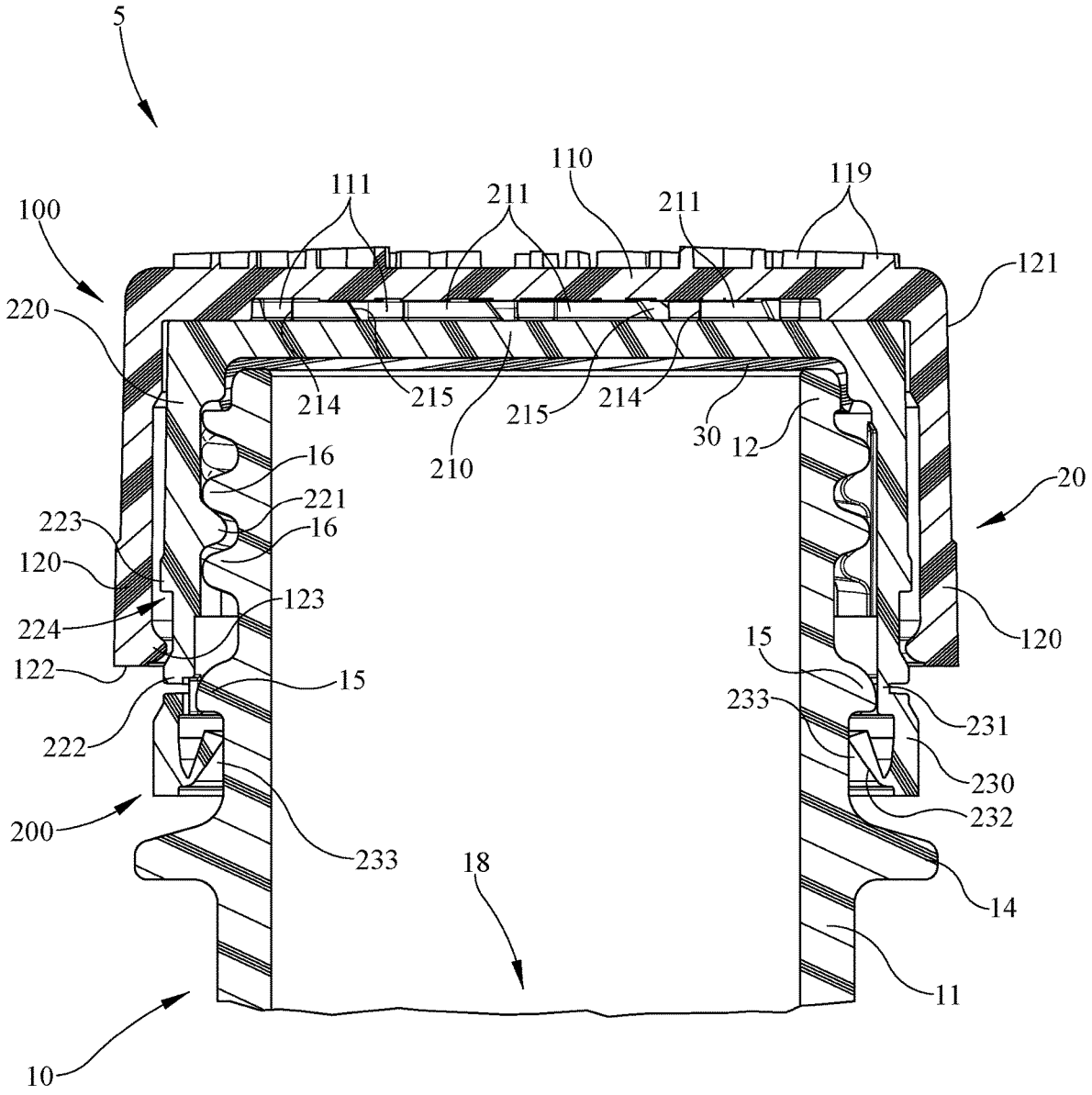
FIG. 4 illustrates a cross section side view of an embodiment of a closure coupled to the neck of a bottle to form a package.
Figure 5:
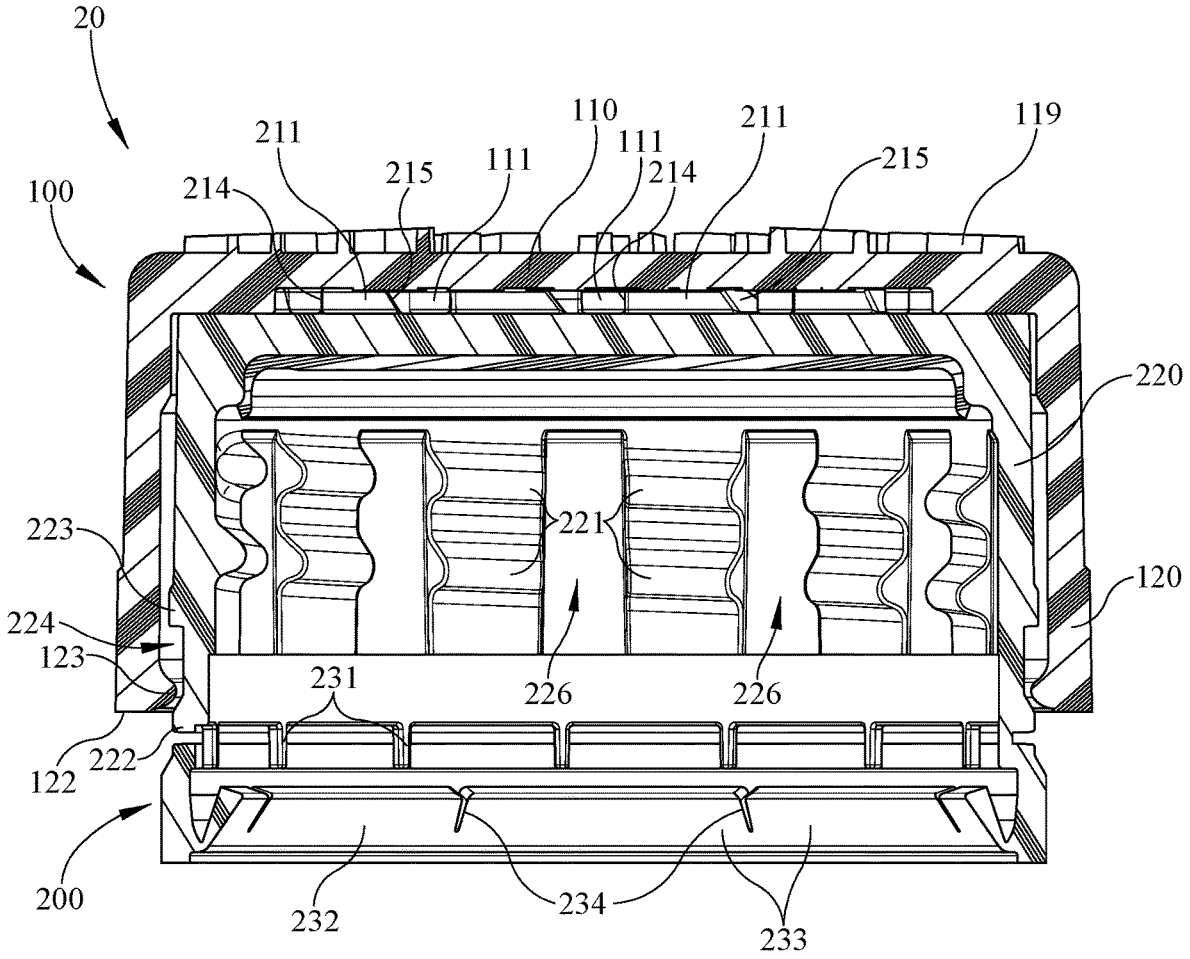
FIG. 5 illustrates a cross section side view of the closure of FIG. 4 without the bottle.

An embodiment of outer shell 100 is shown in more detail in FIG. 2. Outer shell 100 may include lid 110 and an outer skirt 120 depending downwardly from lid 110 toward a bottom edge 122. A radially inwardly projecting protrusion 123 may be located on a lower portion of outer skirt 120, for example, proximate bottom edge 122. Protrusion 123 may be configured to engage a recess 224 of inner shell 200 (see, e.g., FIG. 3), for example, to hold outer shell 100 in place on inner shell 200 and/or to limit, prevent, and/or inhibit vertical or axial movement of outer shell 100 relative to inner shell 200 when coupled thereto to form closure 20. Protrusion 123 and/or recess 224 may be configured as shown in FIGS. 2 and 3 such that relative axial movement is blocked while radial or rotation movement is allowed, which may allow free spinning of outer shell 100 relative to inner shell 200 when in a first or disengaged position in which outer shell 100 is at rest and/or substantially not pushed down onto inner shell 200 enough to cause engagement of lugs 111, 211. Recess 224 may be taller or have a greater axial measurement than protrusion 123 so that protrusion 123 is allowed to move axially some degree, which may be, for example, enough to allow protrusion 123 and/or outer shell 100 to move between the engaged position and the disengaged position.

Figure 7:
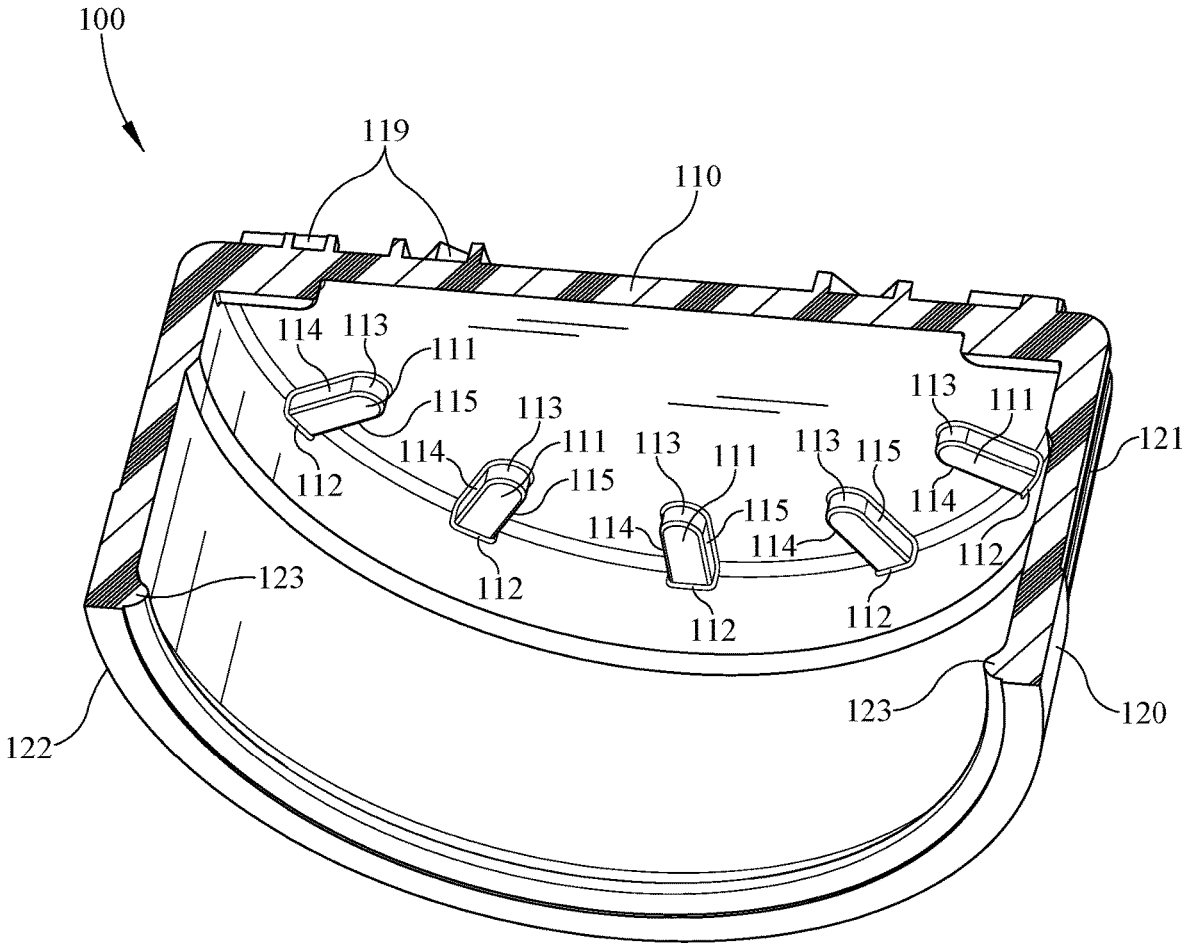
FIG. 7 illustrates a cross section perspective view of the outer shell of FIG. 2.

Outer shell 100 may include an indicia 119 on a top surface, for example, to provide information to a user. For example, indicia 119 may be a verbal message, such as raised lettering, telling a user that is old enough to read to push and turn outer shell 100 in order to open package 5. Outer shell 100 may include one or more knurls 121 around the outside to provide, for example, a surface that is easier for a user to grip and rotate. Outer shell 100 may include one or more lugs 111, for example, on a bottom surface of lid 110. Lugs 111 may include any or all of an outer edge 112, an inner tip 113, a first side wall 114 and/or a second side wall 115 (see also, e.g., FIG. 7). As discussed in more detail below any or all of these features of lug 111 may be included to facilitate engagement and/or cooperation with inner lugs 211.

Inner shell 200 is shown in more detail in FIG. 3. Inner shell 200 may include a cover 210 and inner skirt 220 depending downwardly from cover 210 toward a bottom 222 and/or tamper band 230. Tamper band 230 may include folding strip 232, which may fold from a downwardly extended position (see, e.g., FIG. 6) to an upwardly extended position in which it may abut bead 15 of bottle 10 to block upward movement of tamper band 230 relative to bottle 10. Folding strip 232 may include any or all of one or more segments 233 and/or one or more slits 234 that may at least partially separate adjacent segments 233 and/or provide or optimize flexibility of folding strip 232 and/or tamper band 230. Inner shell skirt 220 may include recess 224, which may be configured to receive and/or engage protrusion 123 of outer shell 100 as discussed above, for example, to limit axial movement of outer shell 100 relative to inner shell 200. Recess 224 may be formed between radially outwardly projecting bottom 222 and lip 223 of inner skirt 220, for example, providing a radially inwardly recessed area at recess 224. Recess 224 may extend a vertical or axial distance between lip 223 and bottom 222 configured to allow some limited vertical or axial movement of protrusion 123 within recess 224. This may allow or facilitate moving outer shell 100 between an upward or disengaged position and a lower or engaged position, for example, by a user pushing down on outer shell 100 to allow outer lugs 111 to engage inner lugs 211.

Inner lugs 211 may include any or all of an outer edge 212, an inner edge 213, a blocking face 214, and a cam face 215. Blocking face 214 may be substantially more vertical than cam face 215. Either or both of first side wall 114 and second side wall 115 of outer lugs 111 may extend in a substantially vertical or axial direction. Rotation of outer shell 100 in a closing direction (e.g., clockwise) relative to inner shell 200 may cause an abutting or mechanically blocking interface between first side wall 114 of outer lug 111 and blocking face 214 of inner lug 211, which in turn may cause closing rotation of inner shell 200 relative to bottle neck 11, and tightening or closing of closure 20 on bottle 10, with or without the downward push or motion caused by the user and/or whether outer shell 100 is in the disengaged position or the engaged position. In this way or in any other way, closure 20 may be closed without the downward force or motion. Cam face 215 of inner lugs 211 and/or second side wall 115 of outer lugs 111 may be sufficiently angled relative to the vertical such that rotation of outer shell 100 in an opening direction (e.g., counter-clockwise) will result in outer lug 111 sliding or camming vertically or axially upwardly and over inner lug 211 without causing opening rotation of inner shell 211. In this way or any other way, outer shell 100 may turn in the opening direction without necessarily causing opening rotation of inner shell 200 (e.g., in the absence of a first user input or downward force on outer shell 100 toward inner shell 200).

Outer lugs 111 and/or inner lugs 211 may be configured such that a downward force or motion may be required to cause enough friction or engagement of second side wall 115 with cam face 215 to cause opening rotation of inner shell 200. Cam face 215 may be helical or helicoid for any of a variety of reasons, including but not limited to optimizing surface contact between outer lugs 111 and inner lugs 211 as will be understood by one of ordinary skill in the art. In some embodiments, cam face 215 may be formed with a helical or helicoid surface that can be defined in that a line extending radially from a center axis of inner shell 200 that is perpendicular to that axis will extend along the surface from inner edge 213 to outer edge 212 despite the varying height of the surface and the varying angular displacement of the surface relative to the center axis over its varying height. Inner shell 200 may include features such as one or more bumps 225, which may be included to optimize or increase friction and/or contact between inner shell 200 and outer shell 100. Any or all bumps 225 may extend radially outwardly from inner skirt 220 and/or may have a curved outer surface as shown for example in FIGS. 1 and 3.

Inner lugs 211 may be arranged substantially at or near an outside diameter or periphery or edge of inner shell 200, as shown for example in FIG. 3. Inner lugs 211 may have a height from base to top. Inner lugs 211 may be arranged at or near the outer edge of inner shell 200 so that adverse effects from doming caused by pressurized contents of package 5, which would generally tend to cause the greatest height increase near the center gradually decreasing toward the outer edge of inner shell 200, may be minimized. Adverse effects could include, but are not limited to, friction between cover 210 and lid 110 of outer shell 110, which could be caused by doming of inner shell cover 210 into contact or interference with lid 110, and/or misalignment or poor contact or interface between outer lugs 111 and inner lugs 211.

Figure 6:
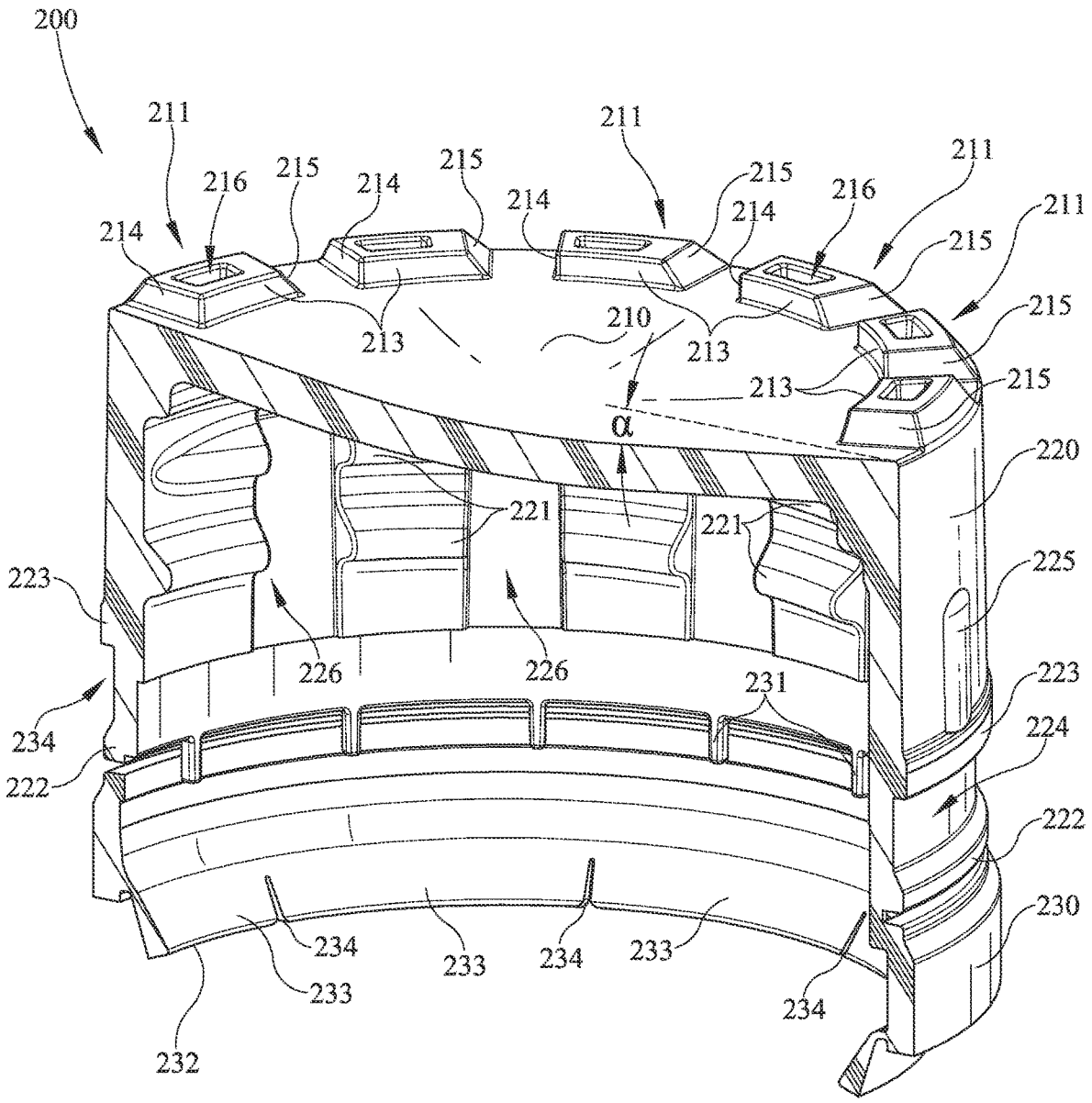
FIG. 6 illustrates a cross section perspective view the inner shell of FIG. 3.

FIGS. 4 through 7 show the features of package 5 and/or closure 20 in additional detail. As shown for example in FIG. 6, folding strip 232 of tamper band 230 may be provided in a downwardly extended or unlocked position, for example prior to being applied to bottle 10. Folding strip 232 may flip or fold upwardly upon installation of tamper band 230 on bottle 10, for example, with folding strip 232 folding up into an upwardly extended or locked position in which it abuts an underside of bead 15 of bottle 10 to prevent upward axial movement of tamper band 230 relative to bottle 10. Inner lugs 211 are shown in FIG. 6 as including a recess or cavity 216 in or on a top portion thereof, which may be included for any of a variety of reasons, including but not limited to reducing the weight and/or amount of material needed to form lugs 211.

Figure 8:
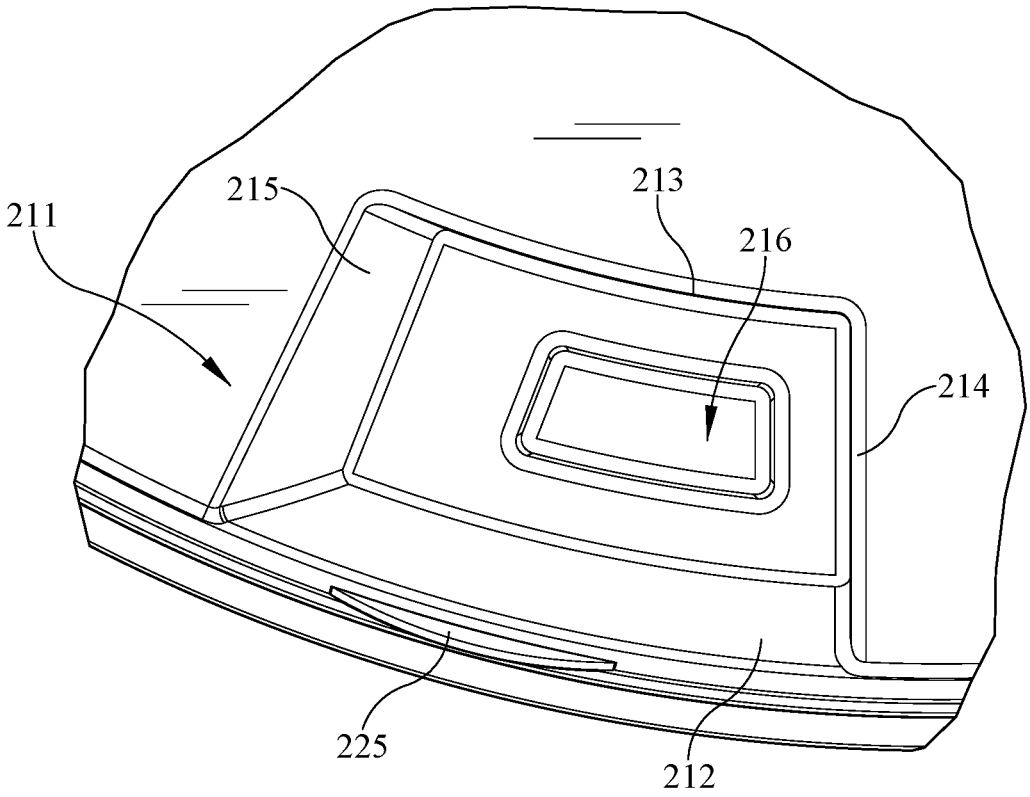
FIG. 8 is a top view of a portion of the inner shell, illustrating an embodiment of an inner shell lug.

FIG. 8 illustrates an embodiment of inner lug 211 in more detail. Lug 211 may be formed around the circumference of inner shell 200 with a round or arcuate inner edge 213 (e.g., about 21.5 degrees in the embodiment shown) and/or cam face 215 may be cut or formed at an angle (e.g., about 4.5 degrees in the embodiment shown), which may result in a helical angle surface of cam face 215. It is understood that these are merely exemplary angles and the angles may vary. Such a helical angled surface of cam face 215 may provide for increased, maximized, and/or line-to-line or face-to-face contact and/or interaction between cam face 215 and the associated side wall of outer lug 111 that it contacts (e.g., first side wall 114 and/or second side wall 215). Any or all inner lugs 211 may have an outer surface at or near outer edge 212 that is angled radially inwardly, as shown for example in FIG. 8, although it is understood that any or all inner lugs 211 may have a substantially vertical outer surface at or near outer edge 212.

In one example of an embodiment of inner shell 200, cover 210 may have a span and/or outer diameter of about 1.2" and/or a thickness of about 0.06". Inner cover 210 may, in some embodiments, be angled downwardly relative to the horizontal at an angle $\alpha$ as it extends radially inwardly from an outer edge or periphery toward the center or a center axis of cover 210 and/or inner shell 200. If angled, cover 210 may be angled at and/or angle $\alpha$ may be about 1-5 degrees, for example, to help offset doming or for any other reason. Doming of cover 210 and/or inner shell 200 may be present and/or expected, for example, if product storage region 18, container 10, and/or package 5 is used to store or hold pressurized contents such as a carbonated beverage. Inner lug 211 may have a height of about 0.10" to about 0.50" and/or about 0.36", and/or a width from inner edge 213 to outer edge 212 of about 0.05" to about 0.2". Inner lugs 211 may have a height at or near inner edge 213 that is shorter than and/or less than a height at or near outer edge 212, which may for example, help accommodate with effects of doming. It is understood that inner lugs 211 may vary in size, shape, and/or configuration.

It is understood that package 5 and/or closure 20, and/or any component thereof, may be made of any of a variety of materials, including, but not limited to, any of a variety of suitable plastics material, any other material, or any combination thereof. Suitable plastics material may include, but is not limited to, polypropylene (PP), polyethylene (PE), polyethylene terephthalate (PET), polystyrene (PS), high-density polyethylene (HDPE), low-density polyethylene (LDPE), linear low-density polyethylene (LLDPE), crystallized polyethylene terephthalate (CPET), mixtures and combinations thereof, or any other plastics material or any mixtures and combinations thereof. It is understood that multiple layers of material may be used for any of a variety of reasons, including to improve barrier properties, or to provide known functions related to multiple layer structures. The multiple layers, if included, may be of various materials, including but not limited to those recited herein.

It is further understood that package 5 and/or closure 20, and/or any component thereof, may be substantially rigid, substantially flexible, a hybrid of rigid and flexible, or any combination of rigid, flexible, and/or hybrid, such as having some areas be flexible and some rigid. It is understood that these examples are merely illustrative, are not limiting, and are provided to illustrate the versatility of options available in various embodiments of package 5 and/or closure 20, and/or any component thereof.

It is further understood that any of a variety of processes or combination thereof may be used to form package 5 and/or closure 20, and/or any component thereof, or any layer or substrate used therein. For example, any component, layer, or substrate, or combination thereof, may be compression molded, thermoformed, injection molded, injection stretch blow molded, blow molded, extrusion blow molded, coextruded, subjected to any other suitable process, or subjected to any combination thereof. In some embodiments, package 5 and/or closure 20, and/or any component thereof may be formed substantially of injection molded and/or thermoformed suitable plastics material, although other materials and forming processes may be used instead of or in addition to injection molding and thermoforming, respectively. Various materials and/or processes may be used to form package 5 and/or closure 20, and/or any component thereof, as will be understood by one of ordinary skill in the art. In some embodiments, package 5 and/or closure 20, and/or any component thereof, may be substantially a one-piece design and/or substantially formed as an integral or unitary structure.

It is understood that, while some directional terms are used herein, such as top, bottom, upper, lower, inward, outward, upward, downward, etc., these terms are not intended to be limiting but rather to relate to one or more exemplary orientations, positions, and/or configurations of package 5 and/or closure 20, and/or any component thereof. It is understood package 5 and/or closure 20, and/or any component or portion thereof may be inverted or re-oriented to face or point a different direction without departing from the nature of package 5 and/or closure 20 disclosed herein.

These and other modifications and variations may be practiced by those of ordinary skill in the art without departing from the spirit and scope, which is more particularly set forth in the appended claims. In addition, it should be understood that aspects of the various embodiments may be interchanged in whole or in part. Furthermore, those of ordinary skill in the art will appreciate that the foregoing description is by way of example only, and it is not intended to limit the scope of that which is described in the claims. Therefore, the spirit and scope of the appended claims should not be limited to the exemplary description of the versions contained herein.

That which is claimed:

1. A closure for a bottle, comprising:

an inner shell having an inner cover and an inner skirt depending from the inner cover in a first axial direction, and an outer shell having a lid and an outer skirt depending from the lid in the first axial direction;

wherein the inner shell includes at least one inner lug disposed on the inner cover and extending away from the inner cover in a second axial direction opposite the first axial direction;

wherein the outer shell includes at least one outer lug;

wherein the at least one outer lug is movable in the first axial direction and the second axial direction relative to the at least one inner lug between an engaged position and a disengaged position;

wherein in the disengaged position the at least one outer lug is able to rotate past the at least one inner lug when rotated in an opening direction;

wherein in the engaged position the at least one outer lug engages the at least one inner lug when rotated in an opening direction to cause opening direction rotation of the inner shell; and a tamper band extending downwardly from a skirt of the inner shell;

wherein the tamper band includes a portion that extends radially inwardly to engage a bead of the bottle;

wherein the at least one inner lug includes an inner edge and an outer edge and wherein the at least one inner lug extends radially outwardly from the inner edge to the outer edge;

wherein the inner cover extends from the inner skirt toward a central axis at a first angle such that the at least one inner lug is disposed downwardly farther in the first axial direction proximate the inner edge than proximate the outer edge to accommodate expected doming of the inner shell.

2. The closure of claim 1, wherein the at least one inner lug includes a cam face.

3. The closure of claim 2, wherein the cam face is formed with a helical angle.

4. The closure of claim 2, wherein the at least one inner lug includes a blocking face opposite the cam face.

5. The closure of claim 1, wherein the at least one inner lug is located on a top surface of the inner shell.

6. The closure of claim 5, wherein the at least one inner lug is arranged proximate an outer periphery of the top surface of the inner shell.

7. The closure of claim 1, wherein the at least one inner lug includes a top portion having a recess.

8. The closure of claim 1, wherein the first angle is in the range of 1 to 5 degrees.

9. A closure for a bottle, comprising:

an inner shell having an inner cover and an inner skirt depending from the inner cover in a first vertical direction, and an outer shell;

wherein the inner shell includes at least one inner lug disposed on the inner cover and extending away from the inner cover in a second vertical direction opposite the first vertical directions;

wherein the outer shell includes at least one outer lug;

wherein the at least one outer lug is axially movable relative to the at least one inner lug between an engaged position and a disengaged position;

wherein in the disengaged position the at least one outer lug is axially displaced relative to the at least one inner lug such that the at least one outer lug is able to rotate past the at least one inner lug when rotated in an opening direction;

wherein in the engaged position the at least one outer lug is at least partially circumferentially aligned with the at least one inner lug such that the at least one outer lug engages the at least one inner lug when rotated in an opening direction to cause opening direction rotation of the inner shell; and a tamper band extending downwardly in the first vertical direction from the inner skirt;

wherein the tamper band includes a portion that extends radially inwardly to engage a bead of the bottle;

wherein the at least one inner lug includes an inner edge and an outer edge, wherein the at least one inner lug outer edge extends upwardly in the second vertical direction to a greater height relative to the inner skirt than the at least one inner lug inner edge to accommodate for doming of the inner shell.

10. The closure of claim 9, wherein the outer shell includes an outer skirt and wherein at least one of the outer skirt and inner skirt include a radial protrusion that is configured to engage a recess on the other of the inner skirt and outer skirt, and wherein the recess accommodates a limited degree of axial movement of the radial protrusion to allow movement of the outer shell between the disengaged position and the engaged position.

11. The closure of claim 9, wherein the at least one inner lug includes at least three inner lugs and the at least one outer lug includes at least three outer lugs.

12. The closure of claim 9, wherein the at least one inner lug is proximate a periphery of the inner shell and the at least one outer lug is proximate a periphery of the outer shell.

13. The closure of claim 9, wherein the at least one inner lug includes an outer surface that is angled radially inwardly.

14. A package, comprising:

a container configured to store pressurized contents, the container having a product storage region and a neck defining an opening; and a closure having an inner shell and an outer shell;

wherein the inner shell includes an inner cover and inner skirt depending downwardly from the inner cover in a first axial direction;

wherein the inner cover includes at least one inner lug extending away from the inner cover in a second axial direction opposite the first axial direction;

wherein the outer shell includes a lid having at least one outer lug;

wherein the at least one outer lug is movable relative to the at least one inner lug in the first axial direction and the second axial direction between an engaged position and a disengaged position;

wherein in the disengaged position the at least one outer lug is able to rotate past the at least one inner lug when rotated in an opening direction;

wherein in the engaged position the at least one outer lug engages the at least one inner lug when rotated in an opening direction to cause opening direction rotation of the inner shell;

wherein the at least one inner lug includes an inner edge and an outer edge and wherein the at least one inner lug extends radially outwardly from the inner edge to the outer edge;

wherein the inner cover extends from the inner skirt downwardly in the first axial direction as it extends toward a central axis at a first angle such that the at least one inner lug is disposed downwardly farther in the first axial direction proximate the inner edge than proximate the outer edge to accommodate expected doming of the inner shell caused by the pressurized contents stored in the container; and a tamper band extending downwardly from a skirt of the inner shell;

wherein the tamper band includes a portion that extends radially inwardly to engage a bead of the container.

15. The package of claim 14, wherein an external side of the container neck includes thread and an internal side of the inner shell includes thread, and wherein the inner shell threads are configured for rotational engagement with the container neck threads.

16. The package of claim 15, wherein at least one of the container neck threads and the inner shell threads are vented.

17. The package of claim 14, wherein the container neck includes a bead and a flange disposed axially below the bead.

18. The package of claim 14, wherein the package further includes a liner covering the opening in the container neck.

19. The package of claim 14, wherein the inner shell has an inner shell skirt that extends in a vertical direction and wherein the at least one inner lug outer edge extends upwardly in the vertical direction to a greater height than the inner lug inner edge.

* * * * *